United States Patent [19]

Bourbeau

[11] Patent Number: 4,804,135

[45] Date of Patent: Feb. 14, 1989

[54] CONTINUOUS STRIP ENVELOPES

[76] Inventor: Gaetan Bourbeau, 18 Lady Sarah Cres., Scarborough, Ontario, Canada

[21] Appl. No.: 163,979

[22] Filed: Mar. 4, 1988

[30] Foreign Application Priority Data

Mar. 6, 1987 [CA] Canada ..... 531446

[51] Int. Cl.[4] ..... B65D 27/10

[52] U.S. Cl. ..... 229/69; 493/233; 493/245

[58] Field of Search ..... 229/69; 282/11.5 A; 493/233, 238, 245

[56] References Cited

U.S. PATENT DOCUMENTS

| | | | |
|---|---|---|---|
| 422,865 | 3/1890 | Wheeler | 229/75 |
| 722,038 | 3/1903 | Pidgeon | 229/69 |
| 1,453,616 | 5/1923 | Benenato | 229/69 |
| 2,013,844 | 9/1935 | Sherman | 229/69 |
| 2,464,490 | 3/1949 | Davies | 229/69 |

FOREIGN PATENT DOCUMENTS

| | | | |
|---|---|---|---|
| 846617 | 7/1970 | Canada . | |
| 954834 | 9/1974 | Canada . | |
| 994298 | 8/1976 | Canada . | |
| 1059470 | 7/1979 | Canada . | |
| 1165285 | 4/1984 | Canada . | |
| 841500 | 7/1960 | United Kingdom | 229/69 |
| 1151717 | 5/1969 | United Kingdom | 229/69 |
| 1239278 | 7/1971 | United Kingdom | 229/69 |

*Primary Examiner*—Stephen P. Garbe

*Attorney, Agent, or Firm*—Nils H. Ljungman

[57] ABSTRACT

The invention comprises a continuous paper strip scored and cut to form a recurring series of alternating panels and associated edge strips, said panels and edge strips being folded upon and secured to one another to produce a series of prefabricated envelopes detachably connected to each other, suitable for feeding to a printer by means of tractor feeding apparatus.

3 Claims, 3 Drawing Sheets

CONTINUOUS STRIP ENVELOPES

BACKGROUND OF THE INVENTION

1. Field of the Invention:

This invention relates to the fabrication of envelopes from continuous strip materials such as a computer printer feed paper.

2. Description of the Prior Art:

With the advent of the computer age, many offices are converting to computers and computer driven printers for the purposes of word processing, accounting and other clerical functions. Accordingly, a great deal of correspondence intended to be sent out of an office is generated on continuous computer sheets. This is highly desirable in many instances because the computer can be programmed to send out a standard letter and insert in each one the names and addresses of the addressee and to make appropriate changes in the text of the letter as may be necessary for each addressee. In this manner, form letters may be addressed to many individuals without having to type each letter individually. Similarly, other types of letters and correspondence may be generated on the computer in a variety of ways to take advantage of the efficiencies of computer programming and the word processing. The problem with this system is that after letters are generated, it becomes necessary to have envelopes addressed to each of the individuals to carry the correspondence. Consequently, it is very desirable to have a continuous strip of envelopes which may be addressed by a computer program in a manner corresponding to the letters being generated with a minimum of manual operations.

In the prior art there have been a number of patents granted for continuous envelope assemblies. Patents of interest in this area include:

Canadian Pat. No. 1,165,285, entitled "Peel Back Mailer", which issued Apr. 10, 1984 to Transkrit Corporation;

Canadian Pat. No. 1,059,470, entitled "Continuous Envelope Assembly", which issued July 31, 1979 to Uarco Incorporated;

Canadian Pat. No. 994,298, entitled "Continuous orm Seamless Envelopes and Method for Making", which issued Aug. 3, 1976 to the United States Envelope Company;

Canadian Pat. No. 846,617, entitled "Multiple Correspondence and Billing Form and Method Thereof", which issued July 14, 1970 to George C. Dagher Jr.; and Canadian Pat. No. 954,834, entitled "Continuous Strip Envelopes", which issued Sept. 17, 1974 to the Societe d'Exploitation des Establisements.

The above cited patents are incorporated herein by reference as if the texts thereof were fully set forth herein.

While these patent disclosures teach methods and means of preparing envelopes from a continuous strip and each has some advantages and disadvantages, it is believed by the inventor that none of the prior art disclosures teaches a continuous strip envelope of the kind described below.

OBJECTS OF THE INVENTION

It is an object of the present invention to provide a continuous strip of paper which is adapted to be folded to produce a series of envelopes which may be detached from the continuous strip.

It is a further object of the present invention to provide a continuous series of prefabricated envelopes which may be detached from one another.

It is a further object of the present invention to provide a continuous strip envelope which is economical in its use of paper.

SUMMARY OF THE INVENTION

This invention comprises a single continuous paper strip having side edges, said strip having disposed serially along its length alternate greater and lesser rectangular areas divided by common transverse folding lines and having associated side edge portions, each said lesser rectangular area being of a size suitable to form the front panel of an envelope, each said greater rectangular area comprising a first panel adapted to form the back panel of an envelope and a second panel adapted to form the flap panel of an envelope, said first and second panels being divided by a second folding line perforated along its length and by cuts extending from the ends of said second folding line toward the corners of said greater rectangular area, said lesser rectangular area being adapted to be folded in a first direction along said first folding line and to be secured to said first panel along their respective overlapping edges, said secured lesser rectangular area and first panel being folded in an opposite direction along said second folding line to form a series of envelopes connected along their sides to said associated side edge portions and to each other along said second folding lines, said associated side edge portions of adjacent envelopes being adapted to be secured to one another at their ends to form continuous side edge strips.

A further aspect of this invention resides in a method of folding the continuous paper strip described above, consisting of the steps of folding a first lesser rectangular area along the first folding line, securing the lesser rectangular area to the first panel along their respective overlapping edges, folding the resulting joined structure in an opposite direction along said second folding line, securing the associated side edges to one another at their overlapping ends, and repeating the steps in respect of each consecutive set of areas and panels.

A further aspect of this invention resides in the product produced by following the method described above.

BRIEF DESCRIPTION OF THE DRAWINGS

In the figures which illustrate the preferred embodiment of this invention.

DESCRIPTION OF A PREFERRED EMBODIMENT

Figure 1:
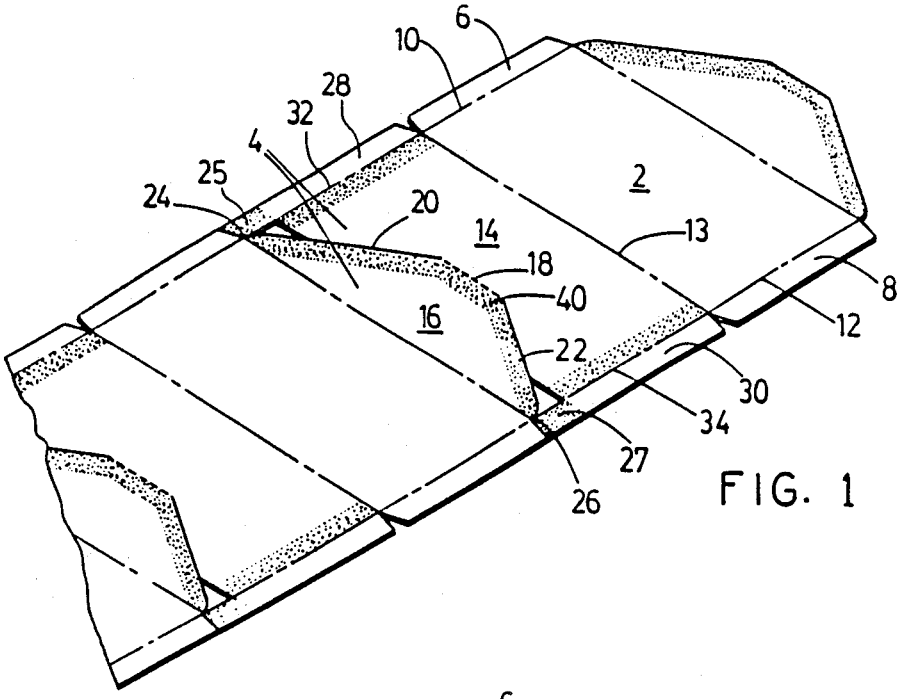
FIG. 1 is a perspective view of a continuous paper strip, cut and scored prior to folding according to the invention.

According to the preferred embodiment of the invention, a continuous strip of paper is cut and scored by conventional equipment to form a longitudinally recurring series of panels and folding lines as described below and as illustrated in FIG. 1.

The continuous strip of paper is cut and scored such that it embodies alternately recurring rectangular panels 2 and composite rectangular area 4 of greater area than rectangular panels 2, as best illustrated in FIG. 1. A transverse folding line 13 divides rectangular panel 2 from composite rectangular area 4. The dimensions of rectangular panel 2 are chosen to correspond to the front panel of an envelope. Rectangular panel 2 is bounded by edge strips 6 and 8 on either side and is separated therefrom by longitudinal folding lines 10 and 12 respectively.

Composite rectangular area 4 comprises a panel 14 the dimensions of which are chosen to correspond to the rear panel of an envelope, and a panel 16 which is sized and cut to correspond to the flap panel of a next adjacent envelope in the continuous strip of paper.

Figure 3:
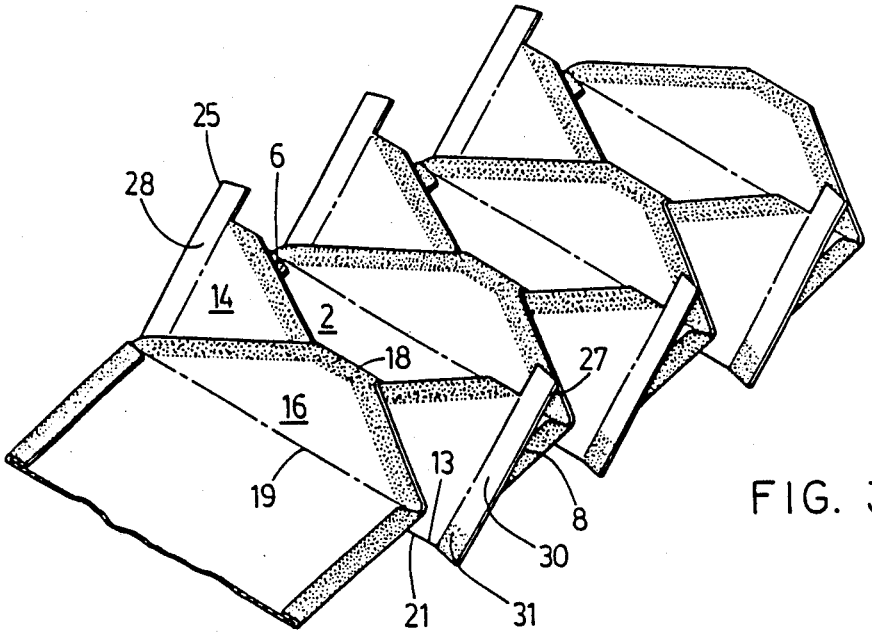
FIG. 3 is a perspective view of a continuous paper strip according to the invention illustrating the folding pattern of alternating panels.
Figure 5:
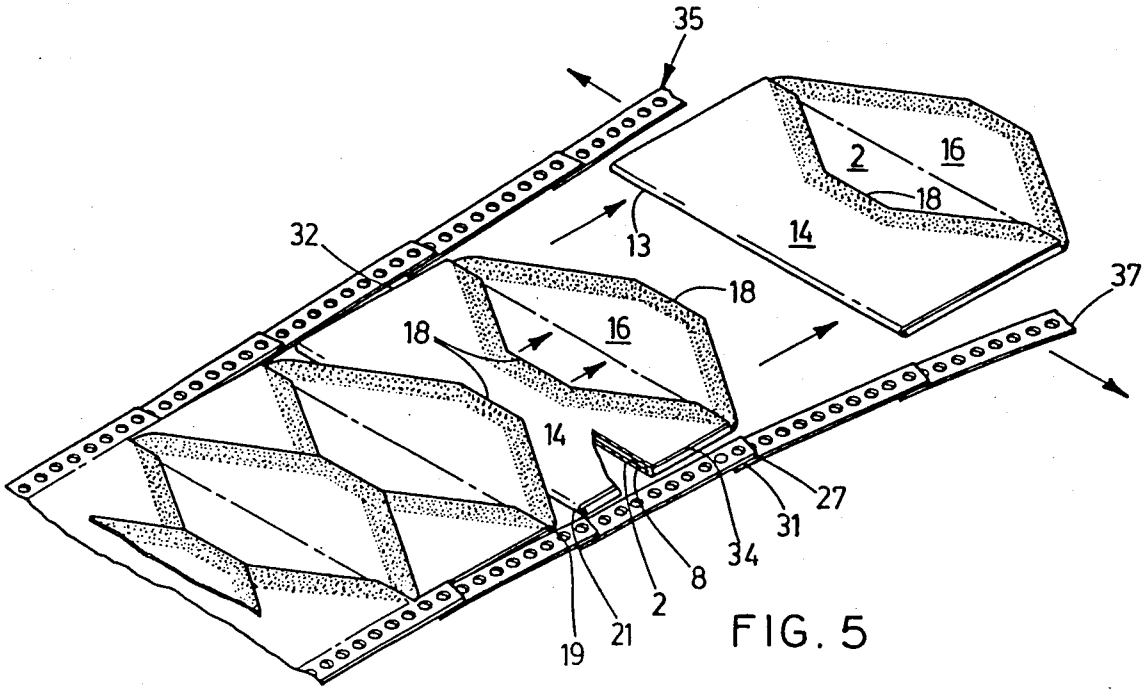
FIG. 5 is a perspective view of a continuous paper strip according to the invention illustrating the removal of a completely formed envelope therefrom.

Rear panel 14 and flap panel 16 of composite rectangular area 4 are separated by a perforated transverse folding line 28 and cuts 20, 22 extending from the ends of folding line 18 substantially to the corners 24, 26 respectively of the composite rectangular area 4. Perforated transverse folding line 18 is located within composite rectangular area 4 such that, when the continuous strip is folded as described below, flap panel 16 will overlap rear panel 14 (thus allowing for closure and securement of flap panel 16 to rear panel 14) and such that upon completion of said folding, the upper edge 19 of the completed envelope will be adjacent lower edge 21 of the next adjacent envelope, as best illustrated in FIGS. 3 and 5. This ensures a uniform thickness to the folded strip.

The sides of composite rectangular area 4 are bounded by edge strips 28, 30 across perforated lines 32, 34.

A suitable adhesive such as, for example, water soluble glue, is applied to the underside of edge strips 6 and 8, to edge portions 25 and 27 of edge strips 28 and 30 and to the underside edge portions of edge strips 28 and 30, only one such portion being visible and designated by the numeral 31 in FIG. 3. Similarly, a suitable adhesive is applied to the forward edge of flap panel 16 as at 40. Once the continuous paper strip is cut and scored as described above, it is adapted to be folded as follows.

Figure 2:
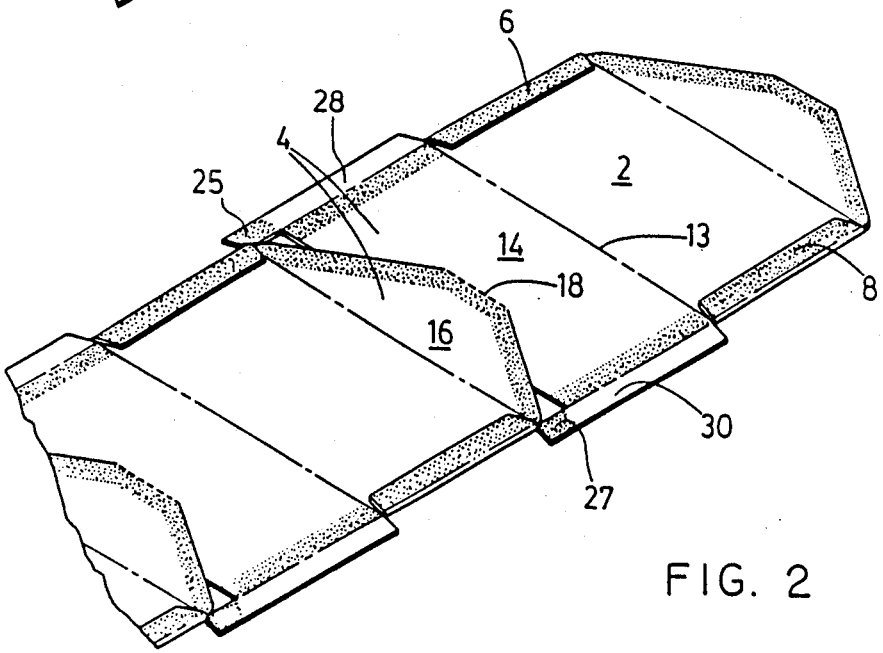
FIG. 2 is a perspective view of a continuous paper strip according to the invention, with the side edges of the lesser rectangular area folded inwardly.

Edge strips 6 and 8 are folded inwardly along folding lines 10 and 12 respectively, as illustrated in FIG. 2.

As illustrated in FIG. 3, front panel 2 is then folded upwardly along folding line 13 such that it overlaps rear panel 14. Edge strips 6 and 8 are secured to rear panel 14 by the adhesive referred to above thereby joining front panel 2 to rear panel 14 to form the body of an envelope, the completed envelope being best illustrated in FIG. 5.

Figure 4:
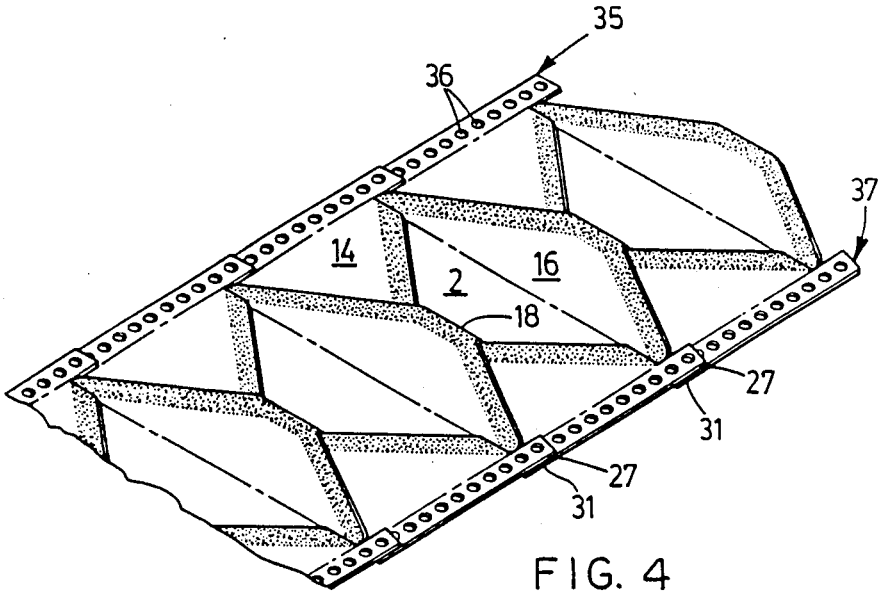
FIG. 4 is a perspective view of a continuous paper strip cut, scored and folded according to the invention.

Rear panel 14 is then folded downwardly along folding line 18 as illustrated in FIG. 3 and FIG. 4 such that the flap panel 16 of the next adjacent envelope partially overlays rear panel 14. Adhesive coated edge portions 25 and 27 are secured to the underside edge portions of edge strips 28 and 30 as illustrated in FIG. 4. The continuous edge strips 35, 37 which are formed thereby are punched to form a series of holes 36.

The result of the above operations is a continuous series of envelopes, as illustrated in FIG. 4, with each envelope attached to the next adjacent envelope by perforated folding line 18. The continuous series of envelopes will also be bounded by continuous edge strips 35, 37 for engaging tractor apparatus of a paper feeder.

Thus, the continuous series of envelopes according to the invention may be fed, by means of a paper feeder, to a printer. Once the stream of envelopes has been fed through the feeder and the printer, the individual envelopes may be detached from one another as illustrated in FIG. 5 by severing edge strips 35, 37 at perforated lines 32, 34 and by severing adjacent envelopes at perforated folding line 18.

It will be appreciated by those skilled in the art that the step of folding edge strips 6 and 8 to rectangular panel 2 may instead consist of folding edge strips 28, 30 inwardly and securing them to rear panel 14 without departing from the scope of the invention. This variation would require that edge portions 25 and 27 be formed as extensions of edge strips 6 and 8 rather than of edge strips 28 and 30, and that the adhesive coating be applied to the underside of edge strips 28 and 30 rather than of edge strips 6 and 8.

The invention as described hereinabove in the context of a preferred embodiment is not to be taken as limited to all of the provided details thereof, since modifications and variations thereof may be made without departing from the spirit and scope of the invention.

What is claimed is:

1. A single continuous paper strip having side edges, said strip having disposed serially along its length alternate greater and lesser rectangular areas divided by common transverse folding lines and having associated side edge portions, each said lesser rectangular area being of a size suitable to form the front panel of an envelope, each said greater rectangular area comprising a first panel adapted to form the back panel of an envelope and a second panel adapted to form the flap panel of an envelope, said first and second panels being divided by a second folding line perforated along its length and by cuts extending from the ends of said second folding line toward the corners of said greater rectangular area, said lesser rectangular area being adapted to be folded in a first direction along said first folding line and to be secured to said first panel along their respective overlapping edges, said secured lesser rectangular area and first panel being adapted to be folded in an opposite direction along said second folding line to form a series of envelopes connected along their sides to said associated side edge portions and to each other along said second folding lines, said associated side edge portions of adjacent envelopes being adapted to be secured to one another at their ends to form continuous side edge strips.

2. The method of forming a continuous series of envelopes from a continuous paper strip as described in claim 1, comprising the following steps:

(a) folding said first lesser rectangular area in said first direction along its associated said first folding line;
(b) securing said lesser rectangular area to said first panel along the said respective overlapping edges to form the body portion of an envelope;
(c) folding said body portion of an envelope in an opposite direction along said second folding line;
(d) securing said associated side edges to one another at their overlapping ends;

(e) repeating steps (a) to (d) for each of the consecutive sets of areas and panels.

3. A single continuous paper strip having side edges, said strip having disposed serially along its length alternate greater and lesser rectangular areas divided by common transverse folding lines and having associated side edge portions, each said lesser rectangular area being of a size suitable to form the front panel of an envelope, each said greater rectangular area comprising a first panel adapted to form the back panel of an envelope and a second panel adapted to form the flap panel of an envelope, said first and second panels being divided by a second folding line perforated along its length and by cuts extending from the ends of said second folding line toward the corners of said greater rectangular area, said lesser rectangular area being folded in a first direction along said first folding line and secured to said first panel along their respective overlapping edges, said secured lesser rectangular area and first panel being folded in an opposite direction along said second folding line to form a series of envelopes connected along their sides to said associated side edge portions and to each other along said second folding lines, said associated side edge portions of adjacent envelopes being secured to one another at their ends to form continuous side edge strips and said continuous side edge strips being provided with means to engage paper feeding apparatus.

* * * * *